United States Patent [19]

Padden

[11] 4,071,078

[45] Jan. 31, 1978

[54] HYDRONIC HEATING AND COOLING SYSTEM

[76] Inventor: William R. Padden, 13823 Heritage Drive, Riverview, Wayne County, Mich. 48192

[21] Appl. No.: 738,424

[22] Filed: Nov. 3, 1976

[51] Int. Cl.[2] ..... F25B 29/00

[52] U.S. Cl. ..... 165/27; 62/394; 62/399; 165/48; 165/63; 165/64

[58] Field of Search ..... 165/27, 48, 58, 61, 165/63, 64; 62/394, 399

[56] References Cited

U.S. PATENT DOCUMENTS

| | | | |
|---|---|---|---|
| 3,563,052 | 2/1971 | Brown | 62/399 X |
| 3,621,673 | 11/1971 | Foust | 62/503 |
| 3,627,031 | 12/1971 | Ware | 165/48 X |
| 3,682,240 | 8/1972 | Cira | 165/61 X |

*Primary Examiner*—Albert W. Davis, Jr.
*Attorney, Agent, or Firm*—Cullen, Settle, Sloman & Cantor

[57] ABSTRACT

The hydronic heating and cooling system includes a packaged or integrated outdoor combination heat and cool unit for both residential and commercial installations comprising control valve means for directing water or liquid through alternately an evaporator for cooling the liquid during the cooling mode of the system or a heater for heating the liquid during the heating mode of the system. With such a construction the liquid passes through the heater in both the heating and cooling modes of the system; however, the heater is energized only in the heating mode.

28 Claims, 5 Drawing Figures

HYDRONIC HEATING AND COOLING SYSTEM

BACKGROUND OF THE INVENTION

1. Field of the Invention

The heating and cooling system is incorporated in a single integrated package or housing which is air cooled and in which the major components are electrically energized supplying either chilled or hot water or liquid on demand for a variety of residential or commercial applications. The heating or cooling functions are changed by simply changing the settings of a master selector switch.

2. Description of the Prior Art

The prior art includes a number of patents disclosing combination heating and cooling systems using a common fluid or liquid for both the heating and cooling modes. Included are the following U.S. Pat. Nos.: 1,963,786, Glenn; 2,984,460, Gardner et al.; 3,159,211, Miner; 3,166,120, Butterfield et al.; 3,235,000, Jacobs; 3,256,929, Carlson; 3,296,815, White; 3,303,873, Ringquist et al.; 3,523,575, Olivieri; 3,547,186, McGrath; 3,648,766, Whalen; and 3,695,574, Worms.

In summary, certain of the patents disclose systems from alternately heating or cooling a common liquid medium using valve means to control the flow path of the medium. However, none of the references discloses the concept of flowing the medium through a heater in both the heating and cooling modes, but only energizing the heater in the heating mode.

SUMMARY OF THE INVENTION

The hydronic heating and cooling system of the present invention is located in a single package or integrated heat and cool unit located normally exteriorly of a residential or commercial installation which includes a number of zones, units or areas to be separately air conditioned upon the demands of the users of such areas. The system or unit is provided with heating and cooling modes controlled by a master selector switch and is adapted to be connected to the terminal system of the zones, units or areas of the buildings to be heated or cooled.

The heat and cool unit which is set for either heating or cooling by the master selector switch comprises a chiller tank provided with a water reservoir in the bottom portion thereof and a closed refrigeration system operative during the cooling mode which includes a compressor, a condenser and an evaporator in operative relation to the water in the chiller tank. The evaporator is located in the chiller tank above the reservoir. A first conduit is adapted to be connected on one end to the terminal system and extends therefrom into the chiller tank at a point below the evaporator. The first conduit includes a riser portion extending upwardly through the evaporator and terminates above the evaporator to permit the water therein to be discharged therefrom and gravity fed across the evaporator into the reservoir during the cooling mode.

The heat and cool unit of the present invention includes a circulating pump and a second conduit connecting the reservoir in the chiller tank to the inlet side of the pump. A third conduit is provided which intersects the first and second conduits. Control valve means is provided for controlling flow in the first and third conduits. A fourth conduit is provided with heating means and is connected on one end to the discharge side of the circulating pump and is adapted to be connected on the other end of the terminal system.

The control valve means when the heating and cooling system is in the heating mode closes the first conduit and directs the flow of water from the first conduit through the third conduit into the second conduit where the water is adapted to be circulated by the circulating pump through the fourth conduit after being heated to the terminal system. The control valve means when the heating and cooling system is in the cooling mode is effective to block flow through the third conduit and open the first conduit thereby permitting the water to be discharged from the riser portion of the first conduit where it is gravity fed across the evaporator into the reservoir. Thereafter, the water from the reservoir enters the inlet side of the pump through the second conduit and is then circulated by the pump through the fourth conduit to the terminal system where the water returns to the heating and cooling system through the first conduit.

It is a feature of the present invention to provide a hydronic heating and cooling system of the aforementioned type wherein the heating means is in the form of an electric heater.

A further feature of the present invention is to provide a hydronic heating and cooling system of the aforementioned type wherein the electric heater is of tubular construction and is interposed in and forms part of the fourth conduit, with the water flowing through the heater during the heating and cooling modes.

A still further feature of the present invention is to provide a hydronic heating and cooling system of the aforementioned type wherein the water in the reservoir of the chiller tank is under atmospheric pressure at all times.

Still another feature of the present invention is to provide a hydronic heating and cooling system of the aforementioned type wherein the control valve means is in the form of electrically operated three-way valve interposed at the intersection of the first and third conduits.

Another feature of the present invention is to provide a hydronic heating and cooling unit of the aforementioned type wherein the control valve means is in the form of a pair of electrically operated two-way valves, one of the valves being located in the first conduit downstream of the intersection of the first and third conduits and being closed during the heating mode and being open during the cooling mode, and the other of the valves being located in the third conduit and being open during the heating mode and being closed during the cooling mode.

DESCRIPTION OF A PREFERRED EMBODIMENT

Figure 1:
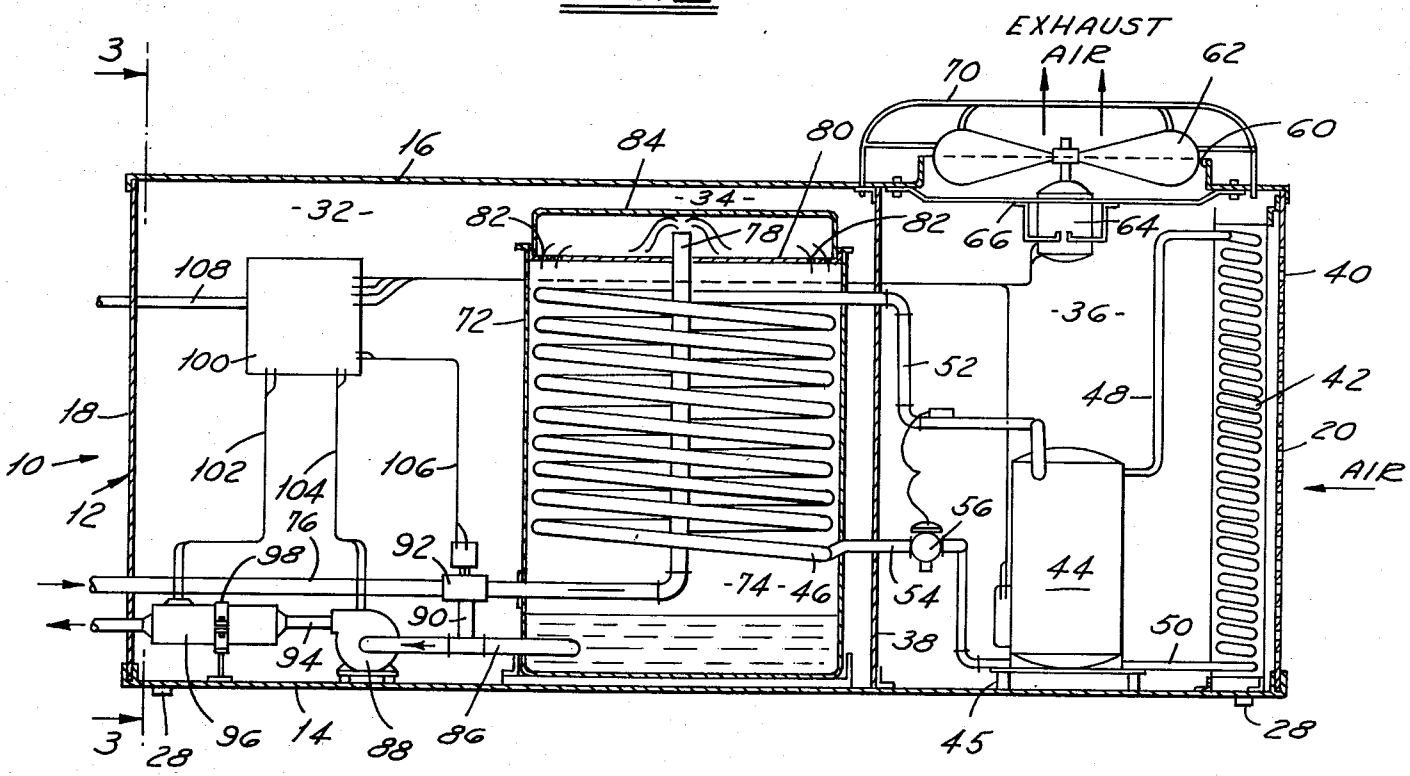
FIG. 1 is an elevational view of the heat and cool unit, with a front wall of the housing removed.

Referring now to the drawings, the heat and cool unit is designated by the numeral 10 and forms the major part of a hydronic heating and cooling system which is adapted to be connected to the terminal system of a residential or commercial installation for delivering hot or cool air thereto.

The heat and cool unit 10 includes a housing 12 having a bottom wall 14, a top wall 16, end walls 18 and 20 and front and back walls 22 and 24. The heat and cool unit 10 is adapted to be mounted outside of a building on a concrete slab 26 and is usually raised therefrom by spacers or runners 28.

Figure 2:
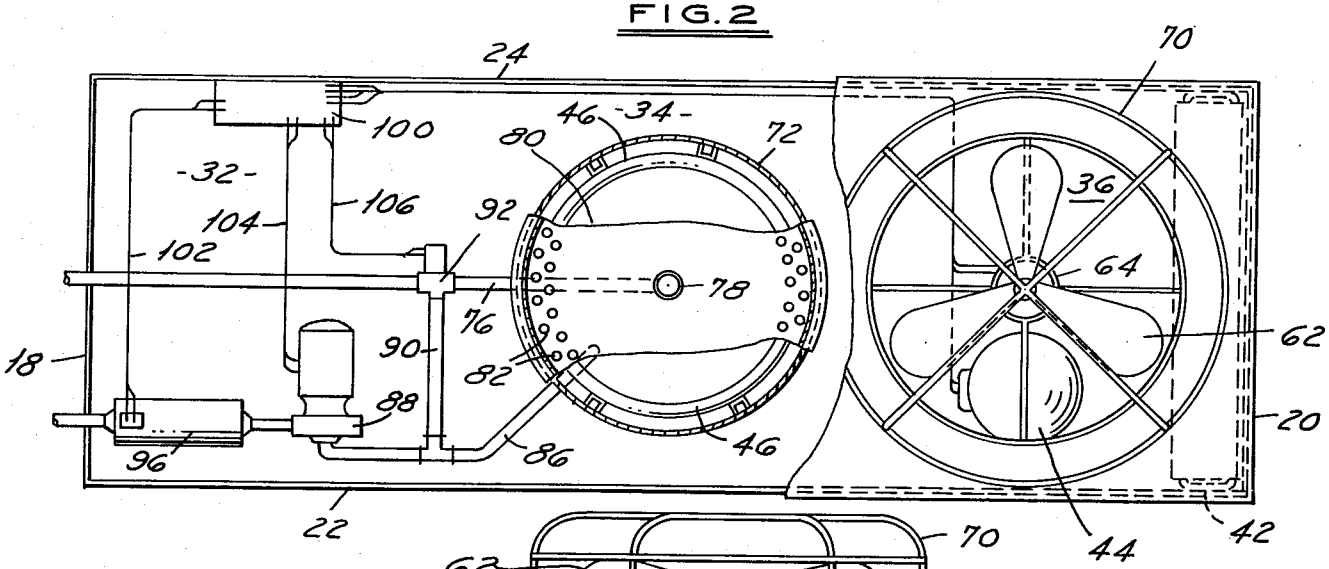
FIG. 2 is a top view of the heat and cool unit illustrated in FIG. 1, with certain parts broken away and in section.
Figure 3:
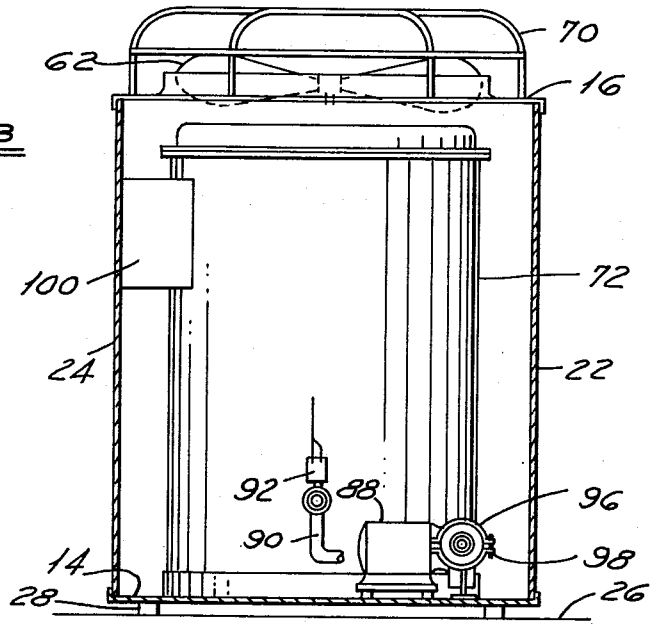
FIG. 3 is a sectional view taken generally on the line 3—3 of FIG. 1.

The housing 12 is divided into sections and includes a heating section 32, a water cooling section 34, and an air circulating section 36, with cooling section 34 being generally centrally located in housing 12 between sections 32 and 36 as illustrated in FIGS. 1 and 2. Sections 34 and 36 are separated by a vertically extending wall or baffle 38 which is secured by suitable fasteners to the top and bottom walls 14 and 16 of housing 12.

The end wall 20 adjacent the air circulating section 36 is provided with a plurality of vertically spaced openings, vents or slots 40 extending generally from the top to the bottom. A closed refrigeration system is provided which consists of a condenser or condenser coil 42 and a compressor 44, located in section 36, and an evaporator or evaporator coil 46 located in the water cooling section 34 as will be subsequently described. The compressor 44 is mounted on a support 45 and is connected to the upper end of coil 42 by a pipe 48; to the lower end of coil 42 by a pipe 50; to the upper end of evaporator coil 46 by a pipe 52; and to the lower end of evaporator coil 46 by a pipe 54. An expansion valve 56 is provided in pipes 52 and 54. The refrigerant or medium compressed by the compressor 48 passes through the condenser and evaporator 46 where the refrigerant evaporates to cool the water in the cooling section 34 before returning to the compressor 48. The refrigerant fluid will circulate through the closed system, with the heat generated dissipated by the condenser 42.

The air circulation section 36 includes an opening 60 in the top wall of the housing 12 in which is located a fan 62 driven by a motor 64 carried by a frame or support 66 which is carried by the top wall 16 as shown in FIG. 1. Thus during the cooling mode the fan 62 is energized to pull or suck air into the housing 12 through vents 40 across the heat exchanger or condenser 42 to remove heat therefrom. The heated air is pulled out of section 36 or exhausted from the housing 12 by the fan 62. A fan guard 70 provided with suitable exhaust openings is mounted above the fan 62 and is secured to the top wall 16 of housing 12.

The water cooling section 34 is provided with a large cylindrical tank 72 having a water reservoir 74 in the lower portion thereof. The water in reservoir 74 is exposed or subjected to atmospheric pressure at all times. The coil evaporator 46 is mounted in the tank 72 above the reservoir 74 as shown in FIG. 1. A first conduit 76 is adapted to be connected on one end to the terminal system and extends through end wall 18, across the heating section 32 and through the tank 72 into the interior thereof. The first conduit includes a riser portion 78 which extends vertically upwardly through coil 46 and terminates at an area above the condenser coil 46. A water distribution pan 80 is located in the upper part of tank 72 and includes an opening for riser 78. The pan 80 is provided with a series of circumferentially extending weep holes 82 which drain the water discharged from riser 78 across the evaporator coil 46 during the cooling mode of the unit and system. The water is gravity fed across the refrigerated evaporator coil 46 so as to cool the water falling into the reservoir 74. The tank 72 is provided with a splash guard or cover 84 to close the top of the tank 72 and to retain the water in the tank 72. Thus the water cooling section has an open system where the water is exposed to atmospheric pressure continuously.

A second conduit 86 extends from the water reservoir 74 through the wall of tank 72 into the water heating section 32 where it is connected to the inlet side of a circulating pump 88.

A third conduit 90 intersects on opposite ends thereof the first and second conduits 76 and 86. Control valve means 92 in the form of an electrically operated three way valve is interposed in conduit 76 at the intersection with conduit 90 so as to control the flow of water through conduits 76 and 90.

A fourth conduit 94 extends from the discharge side of pump 88 through the end wall 18 of housing 12 and from there to the terminal system. The water from the pump 88 is heated during the heating mode by a heater 96 which is interposed in and forms part of the fourth conduit 96. The heater or heating means 96 is of tubular construction and is located on the discharge side of pump 88. Water flows through the heater during both the heating and cooling modes but the heater is only energized during the heating mode. The tubular heater 96 is supported above the bottom wall 14 by a bracket or support 98. The heater 96 may be operated by electricity, solar energy, gas or by heat rejection of the compressor 44.

The heating section 32 includes a control panel secured to the rear wall 24 of the housing 12. As shown in FIGS. 1 and 2, electrical leads 102, 104 and 106 connect the control panel 100 to the electrical heater 96, pump 88 and to the solenoid or electrical type three-way valve 92. A power line or conduit 108 is provided which connects to the electrical power source.

The system or unit may be pre-set to either the heating mode or cooling mode by a master selector or control switch or thermostat 110 (FIG. 4), provided on panel 100. The selector switch or thermostat is changed or set at the start of the hot and cold seasons. Once the selector switch or thermostat 110 is set, the user of the areas where the temperature is to be controlled can only obtain conditioned air determined by the setting of the thermostat 110.

Figure 4:
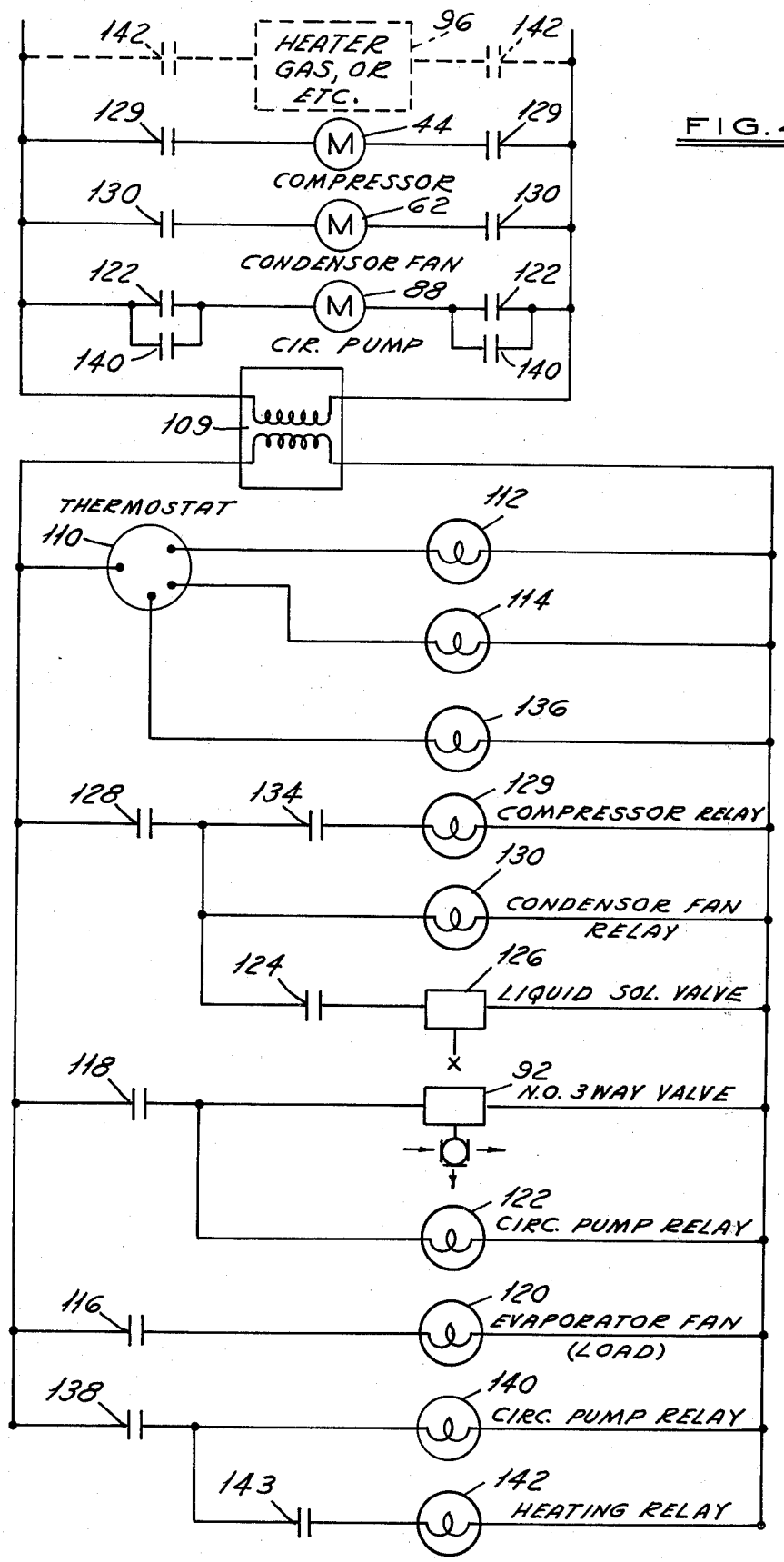
FIG. 4 is an electrical diagram of the heat and cool unit.

The electrical diagram or circuit for the system or unit 10 is shown in greater detail in FIG. 4. The power lines $L_1$, $L_2$ are supplied with current at a voltage of 220.

The control panel 100 contains a control transformer 109 to supply 24 volts for the low voltage control system of the unit 10. When the manual selector switch or thermostat 110 is manually set for cooling, the electrical relays 112 and 114 are energized. The contacts 116 and 118 are closed thereby starting the evaporator fan (load) 120 and energizing the circulating pump-relay 122 thereby starting the circulating pump 88 and opening the three-way spring return valve 92 allowing water to circulate through conduit 76 where the water is discharged from the riser portion 78. The flow of water is blocked in conduit 90 during the cooling mode. The water is distributed by the pan 80 and is gravity fed across the refrigerated evaporator coil 46 thereby being cooled as the water falls into the reservoir 74. When the water flows over the chilled water thermostat 124 and is above 55° F±, the thermostat 124 closes and energizes the liquid refrigerant solenoid valve 126. The solenoid valve 126 opens and allows the liquid refrigerant to flow in the closed refrigeration cycle. As pressure increases the low pressure switch 128 closes energizing the compressor relays 129 and the air cooled condenser fan relays 130 (providing that the safety high pressure limit control or switch 134 is closed) thereby starting the compressor 44 and fan 62. As the temperature of the circulating water decreases to 45° F±, the chilled water thermostat 124 will open and close the liquid refrigerant solenoid valve 126 to stop the flow of refrigerant causing the low pressure switch 128 to open and stop or de-energize the compressor 44 and fan 62. When the temperature of the water is above 55° F± the cycle just described is repeated.

When the thermostat 110 is manually set for heating, the relay 136 is energized. Contact 138 closes to energize the circulating pump relays 140 and heating relay 142 thereby starting the heater (96), provided thermostat 143 is closed. When the thermostat 143 is satisfied the heater 96 is shut off or de-energized until the next demand cycle. During the heating mode the valve 92 blocks flow into the cooling section 34 and directs the flow of water across conduit 90 into the conduit 86 leading to the inlet side of the pump 88. If there is not enough water in the conduits during the heating mode, the pump will replenish same by taking water from reservoir 74.

It should be noted that the three-way valve 92 is spring returned to the heating mode when thermostat 110 is manually switched from cooling to heating and driven open when switched from heating to cooling.

Figure 5:
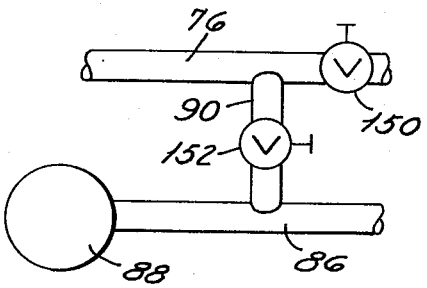
FIG. 5 is a modification of the valve circuitry employed in FIGS. 1–3 inclusive and incorporates two two-way valves rather than one three-way valve.

FIG. 5 illustrates a modification of the control valve means utilized in FIGS. 1–4 inclusive. Rather than using a single three-way valve, two, two-way valves 150 and 152 are employed in conduits 76 and 90 respectively. During the heating mode, valve 150 is closed to block flow of water into the chiller tank 72 while valve 152 is opened to direct the water from conduit 76 directly to the inlet side of pump 88. During the cooling cycle the valve 150 is opened while valve 152 is closed thus directing the entire flow of water into the chiller tank 72.

The term water as used herein means any liquid circulated in an air conditioning system for heating and cooling purposes including brine and other solutions in water.

From the foregoing description, it will be seen that the heating and cooling systems of the present invention achieve the following results: the heat and cool unit may be mounted at ground level or on a roof as an outdoor installation; the unit electrically cools a flowing water system and electrically heats the same liquid; the unit permits the water during the cooling mode to be gravity fed over the evaporator tubes and cooled by a standard D.X. cycle utilizing a freon unit of a standard commercial make; the unit permits the water during the heating mode to bypass the open evaporator reservoir during the cooling mode the unit can be used to heat and cool both residential and commercial installations with one itnegrated package thereby eliminating the necessity of installing separate electric heating and cooling components; the heat and cool unit because of its integrated construction will require less energy than a multiplicity of units; and finally the cost of an installation incorporating the present invention in a multi-rise building is considerably less than conventional designs.

I claim:

1. A hydronic heating and cooling system having heating and cooling modes and adapted to be connected to a terminal system to be heated or cooled comprising a chiller tank provided with a water reservoir in the bottom portion thereof, a refrigeration system operative during the cooling mode and including a compressor, a condenser and an evaporator in operative relationship to the water in said chiller tank, said evaporator being located in said chiller tank above said reservoir, a first conduit adapted to be connected on one end to the terminal system and extending therefrom into said chiller tank at a point below said evaporator, said first conduit including a riser portion extending upwardly through said evaporator and terminating above said evaporator to permit the water therein to be discharged therefrom and gravity fed across the evaporator into said reservoir during the cooling mode, a circulating pump, a second conduit connecting the reservoir in said chiller tank to the inlet side of said pump, a third conduit intersecting said first and second conduits, control valve means for controlling flow in said first and third conduits, a fourth conduit connected on one end to the discharge side of said pump and adapted to be connected on the other end to the terminal system, and heating means for heating the water in said fourth conduit during the heating mode, said valve means when the heating and cooling system is in the heating mode closing said first conduit and directing the flow of water from said first conduit through said third conduit into said second conduit where the water is adapted to be circulated by said pump through the fourth conduit to the terminal system, said valve means when said heating and cooling system is in the cooling mode blocking flow through said third conduit and opening said first conduit thereby permitting the water to be discharged from the riser portion of said first conduit where it is gravity fed across said evaporator into said reservoir, with the water from said reservoir entering the inside side of said pump through the second conduit and thereafter adapted to be circulated by the pump through the fourth conduit to the terminal system where the water returns to the heating and cooling system through said first conduit.

2. The hydronic heating and cooling system defined in claim 1 wherein said heating means and said refrigeration system are electrically energized.

3. The hydronic heating and cooling system defined in claim 1 wherein said heating means is an electric heater.

4. The hydronic heating and cooling system defined in claim 3 wherein said electric heater is of tubular construction and is interposed in and forms part of said fourth conduit, with the water flowing through said heater during the heating and cooling modes.

5. The hydronic heating and cooling system defined in claim 1 wherein said heating means is of tubular construction and is interposed in and forms part of said fourth conduit, with the water flowing through said tubular heating means during the heating and cooling modes.

6. The hydronic heating and cooling system defined in claim 1 wherein the water in the reservoir of said chiller tank is under atmospheric pressure.

7. The hydronic heating and cooling system defined in claim 1 wherein said control valve means is in the form of an electrically operated three-way valve interposed at the intersection of said first and third conduits.

8. The hydronic heating and cooling system defined in claim 1 wherein said control valve means is in the form of a pair of electrically operated two-way valves, one of said valves being located in said first conduit downstream of the intersection of said first and third conduits and being closed during the heating mode and being opened during the cooling mode, and the other of said valves being located in said third conduit and being opened during the heating mode and being closed during the cooling mode.

9. The hydronic heating and cooling system defined in claim 1 wherein during the heating mode, said pump is replenished with water from said reservoir through said second conduit.

10. The hydronic heat and cool unit defined in claim 1 wherein a vertical baffle is provided between said water cooling and air circulating sections, said baffle extending between and being secured to said top and bottom walls.

11. The hydronic heat and cool unit defined in claim 1 wherein an electric control panel is located in said heating section of said housing for controlling said control valve means, pump and heating means during the heating and cooling modes of the unit.

12. An integrated hydronic heat and cool unit comprising a housing having a pair of side walls, a pair of end walls, a bottom wall and a top wall, said housing being divided into a heating section, a water cooling section and an air circulating section, said water cooling section being located between said other sections and including a chiller tank having a water reservoir located in the bottom portion thereof, an evaporator located in said chiller tank above said water reservoir and forming part of a closed refrigeration system, a first conduit extending through an end wall of said housing into said heating section and extending therefrom into said chiller tank, said first conduit including a riser portion extending upwardly through said evaporator and terminating above said evaporator to permit water to be discharged therefrom and gravity fed across the evaporator into said reservoir, said heating section including a circulating pump, a second conduit connected on one end of the inlet side of said pump and extending through said chiller tank into said reservoir, a third conduit in said heating section of said housing connecting said first and second conduits, control valve means in said heating section of said housing for controlling flow of water through said first and third conduits during the heating and cooling modes of the unit, said heating section further including a fourth conduit extending from the discharge side of said pump through said first mentioned end wall of the housing, heating means located in said heating section for heating the water in said fourth conduit as it emerges from said circulating pump during the heating mode, openings in the other end wall of said housing, said air circulating section including a condenser mounted along said other end wall of the housing and a compressor, said compressor being connected to said condenser and to said evaporator to form said closed refrigeration system which is operative during the cooling mode of the unit, the top wall of said housing in said air circulating section being provided with an opening, and motor driven fan located in said last mentioned opening and when energized during the cooling mode being effective to draw air from outside the housing across the condenser to cool same and to discharge the air through said opening in which the fan is located, said control valve means when the unit is in the heating mode being adapted to close said first conduit and direct the flow of water from said first conduit through said third conduit into said second conduit where the water is adapted to be circulated by said pump through the fourth conduit, said control valve means when the unit is in the cooling mode being adapted to block the flow of water through said third conduit and to open said first conduit thereby permitting the water to be discharged from the riser portion of said first conduit where it is adapted to be gravity fed across said evaporator into said reservoir and from where said pump is adapted to withdraw water therefrom through said second conduit and to circulate same through the fourth concuit.

13. The hydronic heat and cool unit defined in claim 12 wherein said heating means and said refrigeration system are electrically energized.

14. The hydronic heat and cool unit defined in claim 12 wherein said heating means is an electric heater.

15. The hydronic heat and cool unit defined in claim 14 wherein said electric heater is of tubular construction and is interposed in and forms part of said fourth conduit, with the water flowing through said heater during the heating and cooling modes.

16. The hydronic heat and cool unit defined in claim 12 wherein said heating means is of tubular construction and is interposed in and forms part of said fourth conduit, with the water flowing through said tubular heating means during the heating and cooling modes.

17. The hydronic heat and cool unit defined in claim 12 wherein the water in the reservoir of said chiller tank is under atmospheric pressure.

18. The hydronic heat and cool unit defined in claim 12 wherein said control valve means is in the form of an electrically operated three-way valve interposed at the intersection of said first and third conduits in the heating section of said housing.

19. The hydronic heat and cool unit defined in claim 12 wherein said control valve means is in the form of a pair of electrically operated two-way valves, one of said valves being located in said first conduit downstream of the intersection of said first and third conduits and being closed during the heating mode and being opened during the cooling mode, and the other of said valves being located in said third conduit and being opened during the heating mode and being closed during the cooling mode.

20. An integrated hydronic heat and cool unit comprising a housing having a pair of side walls, a pair of end walls, a bottom wall and a top wall, said housing being divided into a heating section, a water cooling section and an air circulating section, said water cooling section being located between said other sections and including a chiller tank having a water reservoir located in the bottom portion thereof, an evaporator located in said chiller tank above said water reservoir and forming part of a closed refrigeration system, a first conduit extending through a wall of said housing into said heating section and extending therefrom into said chiller tank, said first conduit including a riser portion extending upwardly through said evaporator and terminating above said evaporator to permit water to be discharged therefrom and gravity fed across the evaporator into said reservoir, said heating section including a circulating pump, a second conduit connected on one end of the inlet side of said pump and extending through said chiller tank into said reservoir, a third conduit in said heating section of said housing connecting said first and second conduits, control valve means in said heating section of said housing for controlling flow of water through said first and third conduits during the heating and cooling modes of the unit, said heating section further including a fourth conduit heating extending from the discharge side of said pump through a wall of the housing, heating means located in said heating section for heating the water in said fourth conduit as it emerges from said circulating pump during the heating mode, said heating means being of tubular construction and being interposed in and forming part of said fourth conduit with the water flowing through said tubular heating means during the heating and cooling modes, said air circulating section including a condenser and a compressor, said compressor being connected to said condenser and to said evaporator to form said closed refrigeration system which is operative during the cooling mode of the unit.

21. The hydronic heat and cool unit defined in claim 20 wherein a vertical baffle is provided between said water cooling and air circulating sections, said baffle extending between and being secured to said top and bottom walls.

22. The hydronic heat and cool unit defined in claim 20 wherein said tubular heating means is electrically operated during the heating mode.

23. The hydronic heat and cool unit defined in claim 20 wherein said control valve means is in the form of an electrically operated three-way valve interposed at the intersection of said first and third conduits in the heating section of said housing.

24. The hydronic heat and cool unit defined in claim 20 wherein said control valve means is in the form of a pair of electrically operated two-way valves, one of said valves being located in said first conduit downstream of the intersection of said first and third conduits and being closed during the heating mode and being opened during the cooling mode, and the other of said valves being located in said third conduit and being opened during the heating mode and being closed during the cooling mode.

25. A hydronic heating and cooling system having heating and cooling modes and adapted to be connected to a terminal system to be heated or cooled comprising a chiller tank provided with a water reservoir in the bottom portion thereof, a refrigeration system operative during the cooling mode to cool the water in said chiller tank, said refrigeration system including an evaporator located in said chiller tank above said reservoir, a first conduit adapted to be connected on one end to the terminal system and extending therefrom into said chiller tank at a point below said evaporator, said first conduit including a riser portion extending upwardly through said evaporator and terminating above said evaporator to permit the water therein to be discharged therefrom and gravity fed across the evaporator into said reservoir during the cooling mode, a circulating pump, a second conduit connecting the reservoir in said chiller tank to the inlet side of said pump, a third conduit intersecting said first and second conduits, control valve means for controlling flow in said first and third conduits, a fourth conduit connected on one end to the discharge side of said pump and adapted to be connected on the other end to the terminal system, and heating means for heating the water in said fourth conduit during the heating mode, said heating means being of tubular construction and being interposed in and forming part of said fourth conduit with the water flowing through said tubular heating means during the heating and cooling modes.

26. The hydronic heating and cooling system defined in claim 25 wherein said tubular heating means is electrically operated during the heating mode.

27. The hydronic heating and cooling system defined in claim 25 wherein said control valve means is in the form of an electricall operated three-way valve interposed at the intersection of said first and third conduits.

28. The hydronic heating and cooling system defined in claim 25 wherein said control valve means is in the form of a pair of electrically operated two-way valves, one of said valves being located in said first conduit downstream of the intersection of said first and third conduits and being closed during the heating mode and being opened during the cooling mode, and the other of said valves being located in said third conduit and being opened during the heating mode and being closed during the cooling mode.

* * * * *